United States Patent [19]
Masaki et al.
[11] 4,209,551
[45] Jun. 24, 1980

[54] METHOD OF FABRICATING A PHOSPHOR SCREEN OF A COLOR TELEVISION PICTURE TUBE

[75] Inventors: Tatsuo Masaki, Tanashi; Keiji Miyajima, Kashiwa; Kenzo Fukuyoshi, Niiza; Hiroji Kumagai, Narashino, all of Japan

[73] Assignee: Toppan Printing Co., Ltd., Tokyo, Japan

[21] Appl. No.: 865,189

[22] Filed: Dec. 28, 1977

[51] Int. Cl.² ..... B05D 5/12; B05D 1/40

[52] U.S. Cl. ..... 427/68; 101/35; 101/150; 101/154; 101/170; 118/211; 427/286; 427/287; 427/288

[58] Field of Search ..... 427/68, 286, 287, 288; 101/41, 150, 154, 35, 170; 118/211

[56] References Cited

U.S. PATENT DOCUMENTS

| | | | |
|---|---|---|---|
| 2,854,348 | 9/1958 | Bowerman | 427/68 |
| 3,255,695 | 6/1966 | Johnson et al. | 427/287 X |
| 3,554,836 | 1/1971 | Steindorf | 156/240 |
| 3,701,317 | 10/1972 | Miyamoto et al. | 101/41 X |
| 3,910,806 | 10/1975 | Schwartz | 427/68 X |

*Primary Examiner*—Evan K. Lawrence
*Attorney, Agent, or Firm*—Bacon & Thomas

[57] ABSTRACT

A method for manufacturing a phosphor screen for a color picture tube is disclosed which comprises the steps of transferring an ink pattern contained on an intaglio having a surface comprising ink receiving portions with a depth of 10μ or more, said ink containing 15 to 90% by volume of phosphor powder, by rotatably moving at a first speed a transcriber having a cylindrical surface covered with a layer of a soft material along the surface of the intaglio in order to apply the ink pattern onto the cylindrical surface of the transcriber and transcribing said ink pattern from said transcriber onto an object to be printed for a color picture tube by rotatably moving the transcriber at a second higher speed along the surface of said object.

16 Claims, 5 Drawing Figures

FIG. 1
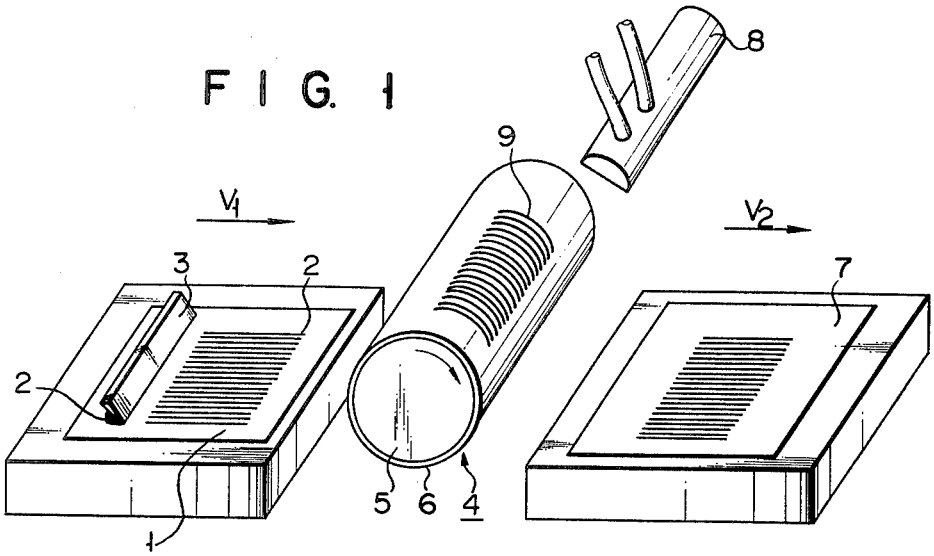
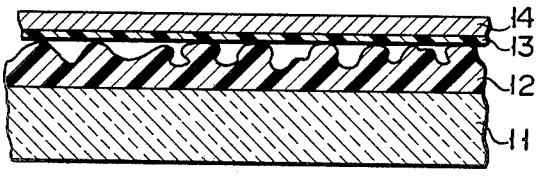
FIG. 2
FIG. 3
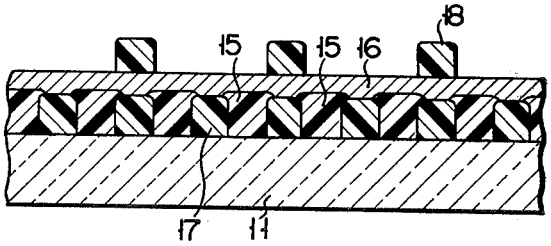
FIG. 4
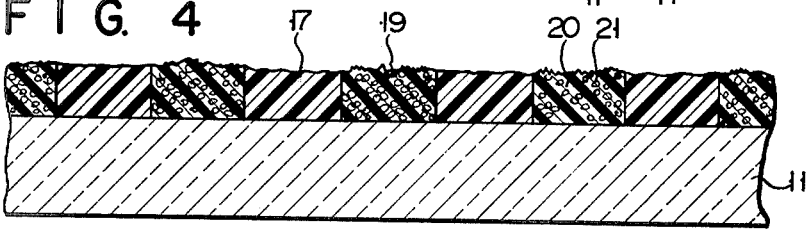
FIG. 5
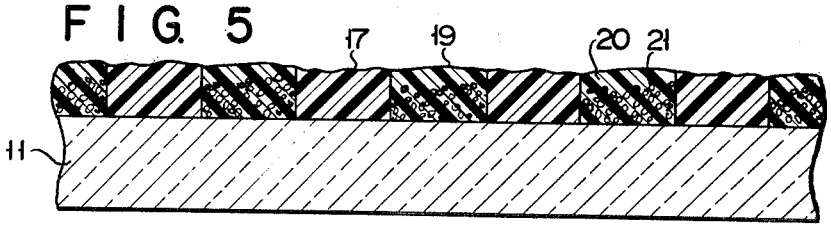

METHOD OF FABRICATING A PHOSPHOR SCREEN OF A COLOR TELEVISION PICTURE TUBE

BACKGROUND OF THE INVENTION

This invention relates to a novel method of fabricating a phosphor screen of a color television picture tube.

A color cathode ray tube is widely applied in a color television receiving set installed in homes, work sites or public facilities. The color cathode ray tube is designed to produce a color picture by forceful and selective irradiation of electron beams and the color light emission of a patterned phosphor layer deposited in the form of dots, matrix or stripes on the inner wall of a face plate of a color picture tube. Needless to say, the ordinary color television receiving set is provided with a phosphor layer capable of issuing light outputs having the three primary colors of red, greed and blue.

Hitherto, the phosphor screen of the color television picture tube has been fabricated by photographic light exposure. Namely, the customary process of preparing the phosphor screen is to apply proper surface treatment to a glass face plate on which a phosphor screen is to be deposited, develop a prescribed pattern by light exposure on a film of photosensitive solution prepared from polyvinyl alcohol ammonium bichromate, scatter black light-absorbing powder such as graphite on said photosensitive film and provide a light absorbing layer by selective photoetching. For example, the conventional slurry process comprises the complicated steps of preparing a slurry by dispersing phosphor powder in a solution sensitized by polyvinyl alcohol bichromate; applying said slurry on the inner wall of a face plate of a color picture tube, followed by drying, light exposure, development and again drying; and repeating these steps three times to provide phosphors emitting light beams having the three primary colors of red, green and blue. The slurry process comprises many steps and is of the wet type, presenting difficulties in respect of stability, cost and disposal of waste liquid. Demand has already been made to develop a much simpler process of fabricating a phosphor screen and in consequence a color picture tube, which is free from the aforesaid drawbacks. A printing method of impressing the pattern form of ink on the face plate of the color picture tube from an engraved intaglio block has been cited as a prospective means for attaining the abovementioned object. However, the customary printing method raised, as described below, too many problems in fabricating a phosphor screen.

To begin with, a high precision pattern is required for phosphor layers emitting light outputs having the three primary colors of red, green, and blue or a light-absorbing layer. Moreover, an object of impression is not a sheet of paper, but often the face plate of a picture tube, that is, a plate of hard glass. Further, the face plate generally has a curved and moreover concave surface, though sometimes having a flat plane. The glass face plate which can not occlude ink unlike paper and whose plane of impression is not flat presents considerable disadvantages in printing. A phosphor screen poses further problems as described below. The respective phosphor layers which have to emit sufficient luminance must be formed with a considerable thickness, as more than 15 microns, because the particle size distribution of color television phosphors is concentrated at the range of 10 to 15 microns. Even a light-absorbing layer should have a larger thickness than 5 microns. Referring to printing ink, it is desired that to elevate the effect of shutting off the respective phosphor layers or causing them to display full luminance, printing ink be made into such type as contains a far larger amount of phosphor particles (corresponding to pigments in the case of ordinary printing ink) or a light-absorbing material than customary printing ink. However, such type of printing ink lacks fluidity and results in an irregular impression. Where the phosphor layer still contains an unduly large amount of resinous component immediately after printing, then the excess resin is left unremoved even during the subsequent baking step, tending to soil a picture tube when it is put into operation. Further, decomposed gases of the resin evolved during the baking step give rise to cracks or blisters in a metal back layer (a light reflection layer) deposited on the phosphor layer, thus producing a disqualified color television receiving set quite unadapted for practical application. Though, therefore, it is necessary to apply printing ink containing a smaller amount of resin, yet such type of ink presents difficulties in patternization by the ordinary printing method.

Further description is given of some concrete printing methods developed particularly for the above-mentioned purpose. The screen process is considered suitable to print ink with a proper thickness. Since, however, the screen printing process causes ink to be applied on the face plate through a mesh, a printed pattern presents irregular edges. Where a phosphor layer is formed of fine lines as narrow as 0.1 to 0.3 mm, the screen process has the drawback that a printed pattern is produced in broken lines. With the screen process, the mesh is forcefully rubbed by, for example, a squeegee. In this case, the mesh tends to be extended, whether made of synthetic fiber or stainless steel, and is subject to limitation in resistance to printing pressure. Further, possible deformation of the phosphor layer pattern during printing has also to be taken into account. Therefore, the screen process makes it impossible not only to carry out multicolor printing of two or three colors but also to reproduce the details of a phosphor layer pattern with high precision.

The so-called octopus head printing method may be cited for the object of printing a phosphor layer on the curved surface of the face plate. However, the octopus head which transfers ink held in an intermediate position to the face plate is depressed by horizontally applied pressure, thus causing ink to be transferred at an uneven printing pressure from the block via the octopus head to the face plate with the resultant failure to attain accurate and uniform transcription of the patterned form of ink over the whole of an impression to be made. Further, the octopus head is made of relatively soft material with a large thickness. Where, therefore, transcription has to be made over a large area, then the resultant impression is subject to prominent deformation, leading to a noticeable decline in the positional precision of a transcribed pattern.

SUMMARY OF THE INVENTION

It is accordingly an object of this invention to provide a method of fabricating a phosphor screen of a color television picture tube which can be operated by a much simpler process than the prior art photographic process and enables a phosphor layer and a light-absorbing layer to be formed with a high pattern precision.

Another object of the invention is to provide an ink composition and printing method adapted to fabricate a phosphor screen of a color television picture tube by a much simpler printing process than has been possible in the past.

According to an aspect of this invention, there is provided a method for manufacturing a phosphor screen for color picture tube comprising transferring an ink pattern from an intaglio having ink receiving portions with a depth of 10μ or more to the cylindrical surface of a transcriber covered with a soft material of 50° or lower rubber hardness by rotatably moving at a first speed and transcriber along the surface of the intaglio in order to apply the ink pattern onto the cylindrical surface of the transcriber, and transcribing said ink pattern from said transcriber on to a face plate of the color picture tube by rotatably moving the transcriber at a second speed along the surface of said object, said second speed being higher than said first speed.

This invention can be more fully understood from the following detailed description when taken in conjunction with the accompanying drawings.

BRIEF DESCRIPTION OF THE DRAWINGS

FIG. 1 is an oblique view of a device embodying this invention which is adapted to fabricate a phosphor screen of a color television picture tube;

FIG. 2 is an enlarged sectional view of a phosphor screen of a color television picture tube prepared by the prior art;

FIG. 3 is an enlarged sectional view of a phosphor screen of a color television picture tube fabricated by the method of the invention;

FIG. 4 is an enlarged sectional view of the condition of a phosphor screen of a color television picture tube immediately after formed by the method of the invention; and FIG. 5 is an enlarged sectional view of the condition of a phosphor screen of a color television picture tube when a considerable length of time has passed after fabrication.

DETAILED DESCRIPTION OF THE INVENTION

According to this invention, a cylindrical member the surface of which is coated with a soft blanket is used as a transcriber. The primary object of the invention is to apply an intaglio block engraved with a larger depth than 10 microns and provided with an ink cell, for impression of an engraved pattern on the peripheral surface of the cylindrical transcriber. Namely, an ink containing 15 to 90% by volume of phosphor powder and 7 to 25% by volume of black light-absorbing powder is transferred in the form of the prescribed pattern from the ink cell to the peripheral surface of the cylindrical transcriber. The transcribed pattern is then impressed on the inner wall of the face plate of the color television picture tube.

There will now be described by reference to FIG. 1, the phosphor layer fabricating method of this invention. An intaglio block 1 comprises engraved portions used as ink cells which are formed with high precision by the photoetching process or gravure block-forming process. FIG. 1 shows striped ink cells in enlargement. A phosphor screen impressed on the face plate of a color television picture tube is formed of patterns such as dots, stripes or a matrix form. All these patterns of the phosphor screen are used as ink cells.

The intaglio block 1 may have an engraved depth of more than 10 or more than 30 microns due to the required large thickness with which a phosphor screen is to be fabricated. Ink 2 is filled in the ink cells of the intaglio block 1 by first spreading an excess amount of the ink 2 over the surface of the intaglio block 1 and then scraping off surplus ink 2 by a doctor 3. A cylindrical transcriber 4 constitutes the vital portion of this invention which is designed to resolve various difficult problems encounted in the conventional phosphor screen-fabricating process. The surface of the cylindrical body 5 of the transcriber 4 is coated with a soft blanket 6 having a smaller rubber hardness than 50° as measured by the JIS A spring type hardness tester (specified in JIS K 6301, 1975) with respect to a test piece more than 12 mm thick. Provision of the above-mentioned soft blanket 6 on the peripheral surface of the cylindrical transcriber 4 enables sand-like coarse-grained ink containing a large amount of powder to be taken up on the transcriber 4 without decreasing the thickness of the deposited ink. Consequently, the patterned form of the ink 2 can be transcribed without loss of its thickness on an object of impression 7 (even if it is made of hard material like glass as in the case of the face plate of the color television picture tube).

In Japan, rubber hardness is determined by a JIS A spring type tester (JIS K 6301, 1975). In the United States of America, rubber hardness is measured by the A or A2 type durometer specified in ASTM D-2240-75. Both forms of measurement are carried out on a rubber sample more than 12 mm thick. Where rubber hardness is measured by the durometer in Japan, then a rubber hardness one or two degrees higher than that obtained by said measurement is taken to correspond to a rubber hardness determined according to the ASTM specification. International rubber hardness degrees (IRHD) based on the international specification (ISO) substantially coincides with those of ASTM.

Where the blanket 6 on the cylindrical transcriber 4 has a low rubber hardness, a thick layer of ink 2 can be transferred to the face plate 7 without loss of thickness. Where said blanket 6 has a higher rubber hardness than 50°, then the ink 2 tends to be decreased in thickness during transcription, even when the rubber blanket 6 has a larger thickness. Where the rubber blanket 6 has a larger thickness than, 30 mm, then loss of the positional precision of the transcribed patterned form of ink 2, namely, the displacement of the outline of a phosphor screen pattern tends to occur even when the rubber blanket 6 has a rubber hardness of 50°. Accordingly, the same drawbacks appear as in the octopus head printing process. When made thin, the rubber blanket 6 is affected by the base material of the transcriber 4. This leads to the same result as that which occurs when the rubber hardness having a direct bearing on printing pressure is increased. The rubber blanket 6 is preferred to have a thickness of at least 0.2 mm even when said rubber blanket 6 has a lower rubber hardness than 20° as measured by the JIS A type rubber hardness tester. A cylindrical transcriber 4 whose surface is partly or wholly coated with a rubber blanket 6 having the above-mentioned thickness enables the patterned form of ink 2 to be transcribed from the intaglio block 1 to the face plate 7 with uniform thickness, or without displacement of the outline of the ink pattern 2. Provision of such soft rubber blanket 6 between the transcriber 4 and the face plate 7 enables the patterned form of ink 2 to be transcribed across them without damaging the impression surface of the face plate 7 even if said impression surface has some irregularities.

The method of this invention uses a larger amount of ink 2, that is, the type having a larger thickness than the customary printing process. Therefore, as the printing operation is continued long, the ink 2 gradually accumulates on the transcriber 4 in such a large amount as can not be fully transferred to the face plate 7 at once. Namely, as the number of printing cycles is increased, the patterned form of ink 2 transcribed to the face plate 7 has a larger thickness, and in extreme cases, the patterned form of the ink 2 itself is thrown out of shape. In such case, it is advised that the surface portion or the whole of the soft blanket 6 be formed of silicone rubber of low hardness. This silicone rubber does not indeed allow the patterned form of ink 2 to be easily transferred from the intaglio block 1 to the transcriber 4, but enables said patterned form of ink 2 to be readily transcribed to the face plate 7 due to said ink 2 being easily released from the silicone rubber. Therefore, a larger amount of ink 2 is rather transferred from the transcriber 4 to the face plate 7, with the result that little ink 2 remains on the surface of the transcriber 4 after each cycle of printing. The soft blanket 6 may be formed of, for example, a fluorine compound having a property of ensuring the easy release of a deposited material. The surface of the soft blanket 6 may be coated with silicone compound or fluorine compound. Where the surface portion of the soft blanket 6 is formed of any of the above-mentioned materials admitting easy removal of deposited ink 2, then not only a thin patterned form of ink 2 but also the type having as large a thickness as 10 to 30 microns can be almost fully transcribed from the transcriber 4 to the face plate 7.

The transcription of the patterned film 9 of ink 2 from the transcriber 4 to the face plate 7 can be promoted by taking means shown in FIG. 1, namely, by drying the surface of the patterned film 9 of ink 2 deposited on the soft blanket 6 transcriber 4 after each cycle of printing by a suitable drier 8, or forcefully drying the surface of said patterned film 9 after a certain length of time, before transcription is carried out. This process increases the viscosity of the ink 2 and slightly promotes its coagulation. The viscosity of the ink 2 increased by drying causes that plane of the ink 2 which faces the face plate 7 to be rendered more than that plane of the ink 2 which faces the soft blanket 6 of the transcriber 4. As mentioned above, proper drying renders the surface of the patterned film 9 of the ink 2 more coagulated and in consequence more viscous. The deepest portion of the ink 2 which contacts the soft blanket 6 of the transcriber 4 is least affected by drying and retains the original low viscosity of the ink 2. Peeling of the patterned film 9 of the ink 2 starts at said deepest portion, enabling 60 to 80% of the ink 2 deposited on the soft blanket 6 of the transcriber 4 to be easily transferred to the face plate 7.

The requisite conditions in which the patterned film 9 of the ink 2 should be dried for its more efficient transcription on an object of impression, for example, the face plate 7 have to be properly defined in consideration of the property of the ink 2 used, the velocity of transcription and the materials of the transcriber 4 and face plate 7.

The drier 8 may be of the hot air, extreme infra-red, or infra-red type or a combination type thereof or microwave type. This drier 8 enables a large amount of ink 2 to be transferred to the face plate 7, depending on the property of the ink 2 and the material of the transcriber 4 (for example, silicone rubber constituting the soft blanket 6 of said transcriber 4 which has a property of ensuring the easy release of the ink 2 deposited thereon). An ultraviolet ray curing ink can be quickly and efficiently dried by an ultraviolet ray-dryer or electron irradiator. Further, it is possible to provide many other drying systems by combining the above-mentioned driers with, for example, moisture-setting ink or thermosetting ink.

Where the soft blanket 6 of an offset type transcriber 4 is formed of silicone rubber or fluorine-base resin which has a property of easily releasing the ink 2 deposited thereon, then 80 to 100% of the ink 2 deposited on said soft blanket 6 can be readily transferred from the transcriber 4 to the face plate 7.

As described above, the phosphor screen-fabricating method of this invention is very effective where a patterned phosphor screen is impressed on the inner wall of the face plate 7 with an appreciable thickness by means of ink 2 containing more than 30% by volume of pigment or inorganic filler, or where it is necessary to provide a phosphor screen by transcribing the patterned film 9 of ink 2 which is so soft as readily to crumble and has as large a thickness as 20 to 30 microns. The reason is that since the patterned film 9 of ink 2 is transcribed on the face plate 7 after previously dried solid, the patterned film 9 is rather unlikely to be thrown out of shape during transcription from the soft blanket 6 of the cylindrical transcriber 4 to the face plate 7. Therefore, the method of the invention proves very useful, where the patterned film 9 of ink 2 is to be efficiently transcribed on the face plate 7 without losing the transcription precision of the patterned film 9. Moreover, since the patterned film 9 of ink 2 deposited on the rubber blanket 6 having a high ink-releasing property can be fully transferred to the face plate 7, it is possible to omit the step of cleaning the surface of a transcriber as is generally required for the ordinary intaglio offset printing for each cycle of printing.

The above-mentioned conditions applied in the method of this invention enable ink 2 having various degrees of viscosity and fluidity to be deposited on the face plate 7 with a proper thickness to fabricate a phosphor screen. However, the patterned form of ink 2 containing a large amount of, for example, pigment (solid components other than resin and solvent) to offer a more rigid printing property takes the coarse-grained sandy form, and presents difficulties in being transcribed to the face plate 7 with a uniform density.

Where the cylindrical transcriber 4 is rotated more slowly (at less than 100 mm/sec) than at the customary speed (even the ordinary offset proof press has a higher transcription velocity than 200 mm/sec) in order to deposit the patterned form of the above-mentioned coarse-grained ink 2 in a larger amount on the rubber blanket 6 of the transcriber 4 having a high ink-releasing property, then even said ink 2 pattern can be clearly transferred from the intaglio block 1 to the surface of said rubber blanket 6. However, soft ink admitting doctoring which is used in gravure offset printing tends to take a raised form when deposited on the surface of the rubber blanket 6. When, therefore, transcribed on the face plate 7, the patterned form of such soft ink 2 is likely to get out of shape. Therefore, the transcriber 4 carrying such soft ink 2 has to be rotated on the face plate 7 at a speed twice higher than the speed on the intaglio block.

Reverting to FIG. 1, excess ink 2 remaining on the surface of the intaglio block 1 is scraped off by a doctor blade 3. After a proper amount of ink 2 is filled in the engraved portions of the intaglio block 1, the transcriber 4 is rotated at a velocity $v_1$, causing the patterned film 9 of the ink 2 to be deposited on the soft rubber blanket 6. The surface of the deposited patterned film 9 of the ink 2 is properly dried by the drier 8. Later, the transcriber 4 is rotated at a velocity $v_2$ to transcribe the patterned film 9 of the ink 2 from the transcriber 4 to the face plate 7. In this case, the transcriber 4 is rotated on the integlio block 1 at a lower speed $v_1$ and on the face plate 7 at a higher speed $v_2$ than $v_1$, thereby ensuring the proper transcription of the patterned film 9 of the ink 2. Namely, the transcriber 4 is rotated slowly on the intaglio block 1, thereby causing a larger amount of ink 2 to be transferred from the engraved portions of the intaglio block 1 to the surface of the soft rubber blanket 6 of the transcriber 4 than when the transcriber 4 is rotated more quickly. Since the transcriber 4 is rotated more quickly on the face plate 7, the patterned film 9 of the ink 2 can be quickly transcribed on the face plate 7 by the high ink-releasing property of the soft rubber blanket 6 without getting out of shape. The velocity at which the film 2 is transferred from the intaglio block 1 to the transcriber 4 is chosen to be less than 150 mm/sec, or preferably 100 mm/sec. In any case, it is advised to select a velocity of transference in consideration of the property of the ink 2 used. The velocity at which the patterned form of the ink 2 is transcribed on the face plate 7 is set at a higher level.

Description has been given of the conditions in which the patterned film 9 of the ink 2 should be transcribed on the face plate 7. There will now be discussed the requirements for said transcription to be carried out with high precision. Where the patterned film 9 of the ink 2 takes the form of a stripe as in the foregoing embodiment of this invention, it has been discovered that when the intaglio block 1, transcriber 4 and face plate 7 have such relative positions as ensure coincidence between the direction in which the stripe is to be formed on the face plate 7 and the direction in which the transcriber 4 is rotated, then the precision with which the patterned film 9 of the ink 2 is transcribed on the face plate 7 is prominently elevated. Coincidence in the above-mentioned directions most effectively restricts the bleeding and deformation of the patterned film 9 of the ink 2 in a direction perpendicular to that in which the stripe extends, thereby ensuring transcription with high precision.

As previously described, the method of this invention makes it possible to use even such ink as would be unsuitable for ordinary printing. Namely, the invention admits of application of the ink which contains, for example, more than 30% by volume (or 65% by weight) of color television phosphor powder having a higher specific gravity than 4. Since such dense ink has low fluidity and tends to plug meshes, the prior art screen printing method fails to print a phosphor screen pattern with so high precision as is attainable by the method of this invention. According to this invention, the transcriber 4 is coated with the soft rubber blanket 6. Therefore, the patterned film 9 of the ink 2 can be easily transcribed on the face plate 7 within the deformation limit of said rubber blanket 6, regardless of whether the face plate 7 has a flat or slightly curved surface. Where an object of impression takes a round cylindrical form, the patterned film 9 of the ink 2 can be impressed thereon by rotating the transcriber 4 along the curved peripheral surface of said object. Technically speaking, the method of this invention can impress the patterned film 9 of the ink 2 on an object of impression, regardless of whether it is formed of pliable paper, plastic material, or hard rigid metal. Where an object of impression is formed of, for example, glass, ceramic or porcelain which is hard and brittle, has a low impact strength, and has little acceptance capacity for ink, the patterned film 9 of the ink 2 transcribed from the transcriber 4 coated with the soft rubber blanket 6 of this invention is most adapted for impression, due to the desirable effect of said blanket 6, the high releaseability of the ink 2 and the general demand for the ink 2 to contain a large amount of solid components, for example, pigment powders like phosphor and graphite powders. The object of this invention is attained with respect to not only the face plate of the color picture tube, but also heat-resistant plastic film or a transcription paper support for forming a phosphor screen.

For better understanding of this invention, there will now be described the construction of the phosphor screen of the color picture tube, before the composition of the ink used in this invention is discussed. The phosphor screen of the conventional color picture tube is fabricated as follows. A phosphor screen 12 emitting light outputs of the three primary colors of red, green and blue is deposited on the inner wall of the face plate 11 of the color picture tube. A metal back layer 14 is provided by vacuum thermal deposition of a metal film having high reflectivity on said phosphor screen. This metal back layer 14 has the very important effect of elevating by its reflecting property the brightness of light outputs emitted from the phosphors and preventing the phosphors from being negatively charged by electron beams and burnt by ions.

However, the prior art phosphor screen fabricated by photographic light exposure has the drawbacks that since the phosphor screen 12 contains a small amount of resin, direct thermal deposition of a metal back layer 14 on the phosphor screen 12 gives rise to the occurrence of noticeable irregularities on the surface of the phosphor screen 12; consequently the metal back layer 14 fails to have a mirror-like plane with the resultant loss of desired reflected brightness. To eliminate this difficulty, a flat smooth resin intermediate layer 13 is provided, and the metal back layer 14 is thermally formed on this intermediate resin layer 13.

The known process of filming the intermediate resin layer 13 includes the dripping method, spray method, emulsion method and fluidization method. All these methods call for advanced technique and present considerable difficulties in operation control, leading to production of a high percentage of disqualified color television receiving sets and in consequence a rise in manufacturing cost.

According to this invention, the phosphor screen 12 is formed of not only phosphor powder or organic filler, but also as much resin as 25 to 85% by volume. Therefore, it has been discovered that (1) even if a metal back plate 14 is directly thermally deposited on the phosphor screen 12, the metal back plate 14 is prevented from penetrating the phosphor screen 12 to be deposited on the face plate 11, and (2) the surface of the phosphor screen 12 is made smooth due to a large content of resin, ensuring a satisfactory reflected luminance. However, a large content of resin in the phosphor screen 12 has the drawback that in the subsequent baking process for evaporating organic ingredients from the resin, the overlying metal back layer 14 tends to blister or be cracked by vapors evolved from the resin. The present inventor's study shows that the blisters or cracks of the metal back plate 14 take place in varying degrees according to the kind of the resin, namely, that with respect to polyester resin or acrylic resin, the metal back plate 14 is not subject to blisters or cracks, even when the resin content of the phosphor screen 12 runs as high as 85% by volume (41% by weight in the case of a color television phosphor screen).

The reason why the phosphor screen 12 fabricated by ink containing polyester resin or acrylic resin as a binder gives good results is not yet clearly defined. At any rate, application of ink containing such resin makes it possible, as shown in FIG. 3, thermally to deposit the metal back plate 16 directly on the phosphor screen 15 formed on the inner wall of the face plate 11, without the necessity of providing the intermediate resin layer 13 as used with the convention color picture tube. Referential numeral 17 of FIG. 3 denotes a light-absorbing layer, and referential numeral 18 shows a beam index pattern emitting ultraviolet-rays when irradiated by electron beams. The resin-containing ink which is hardenable by ultraviolet-rays contains a larger amount of phosphor screen-forming component than the solvent type ink and therefore is preferred as well as in view of its higher printability. Further, it is desired that 0.04 to 1.50 mols of a (metha)acryloyl radical be contained as an unsaturated ethylene series radical in the composition of an ink vehicle based on 100 g thereof. Good results are also attained by application of an ink whose vehicle composition contains 0.1 to 0.7 mol of a (metha)acryloyl radical as an unsaturated ethylene series resin and one, two or more compounds selected from the group consisting of saturated polyester resin, unsaturated polyester resin and alkyd resin. The saturated polyester resin includes polycondensates of tere- or isophthalic acid and ethylene oxide. The unsaturated polyester resin includes polycondensates of polyhydric alcohol such as ethylene glycol and unsaturated dibasic acid such as anhydrous maleic acid. The alkyd resin preferably includes partly oil-denatured polycondensates of polyhydric alcohol such as pentaerythritol and polybasic acid such as anhydrous phthalic acid, and said polycondensates mixed with (metha)acrylic acid.

As seen from FIG. 4, the phosphor screen 19 has an uneven surface immediately after fabrication. Where, in this case, it is desired to let the ink display the same effect as the previously described intermediate resin layer 13 (FIG. 2), then it is advised to smooth the surface of a fabricated phosphor screen 19 which has been allowed to stand for a certain length of time after the patterned film 9 of the ink 2 is transcribed on the inner wall of the face plate 11 and thermally deposit an aluminium back layer. This procedure provides a mirror-like light-reflecting plane. Promotion of the light-reflecting effect is attained by mixing the phosphor ink with a proper amount of any or combination of the following compounds in consideration of the composition of said ink:

(1) a slowly-drying solvent capable of preventing the ink film from being solidified while the phosphor screen is smoothed, such as benzyl alcohol, octyl alcohol, or phenyl methyl carbinol;

(2) a precipitation promotor such as dimethyl silicone oil which causes phosphors 21 having a high specific gravity (more than 4 in the case of color television pohophor) to precipitate while uniformly dispersed in the phosphor screen 19, thereby smoothly coating the surface of the phosphor screen 19 with the ink vehicle formed of, for example, resin;

(3) a plasticizer such as dibutyl phthalate or diethyl phthalate which keeps the ink layer itself fluidized.

There will now be described the phosphor powder contained in the ink. The phosphor powder may be of the same type as used in the photographic light exposure process. Generally, a red light-emitting phosphor is formed of a yttrium series compound. A green or blue light-emitting phosphor is prepared from a zinc sulfide series compound. These phosphors producing light rays having the three primary colors should be of the types, which, when made to emit light rays jointly, provide a white light. Where one or two of the three phosphors 21 happen to have an improportionately higher luminance than the other, then it is advised to add an inorganic impurity to the defective phosphor. This inorganic impurity includes calcium salts such as calcium carbonate and calcium sulfate; oxides such as silica, alumina and titanium white; barium salts such as barium sulfate and barium carbonate; and magnesium salt such as magnesium carbonate. In other words, any inorganic impurity can be used for the above-mentioned object which little affects the light-emitting characteristics of the phosphor powder and obstructs the penetration of electron beams through the phosphor powder. The above-mentioned inorganic impurities may be added to the ink by a simple process while the ink is prepared. This process enables the unduly high luminance of a given phosphor to be balanced with that of any other phosphor, thereby ensuring the easy adjustment of all the light rays issued from the three phosphors to an apparent white color.

There has been described the method of this invention for fabricating a phosphor screen of a color picture tube. Now some additional explanation may be made. The phosphor screen is generally fabricated first by forming light-absorbing layers in the selected portions of the phosphor screen, and then depositing the three phosphors emitting light outputs of red, green and blue in those portions of the phosphor screen which are not provided with said light-absorbing layers in the order mentioned in accurate positional alignment. In principle, the impression of the phosphor screen is little different from ordinary multicolor printing. The above-mentioned order is followed in the direct impression of a phosphor screen on the inner wall of the face plate of the color picture tube. After formation of the respective phosphors, a metal back layer is spread over the whole of the phosphor screen by vacuum thermal deposition. Where a beam index type color picture tube is used instead of the shadow mask type, a beam index layer is further deposited on the metal back layer. This beam index layer can be provided by the method of this invention as in the case of light-absorbing layers and phosphor layers.

Where the transcription process is applied in place of the direct impression process, the phosphor layers are formed on a transcription paper support in the opposite order to that which is followed in the direct impression. After pasted on the inner wall of the face plate, the transcription paper support is removed to complete transcription. Fabrication of the phosphor screen is brought to an end when excess resin is removed after baking the phosphor screen, as in the case of direct impression.

This invention will be more fully understood by reference to the example which follow.

EXAMPLE 1

A light-absorbing film was formed on a face plate (flat) by gravure-offset printing according to the following procedure.

| Ink composition: | Weight % | Volume % |
|---|---|---|
| Graphite powder | 30 | 16 |
| Ultraviolet-ray curing varnish (see NOTE) | 70 | 84 |

NOTE: Composition of ultraviolet-ray curing varnish:

| | |
|---|---|
| NK Ester A-TMM-3* | 93 |
| Benzophenone | 5 |
| Triethanolamine | 3 |

*NK Ester A-TMM-3 is an oligoester polyhydric acrylate prepolymer from Shin-Nakamura Kagaku Kogyo Co., Ltd., Japan which contains approximately 1.07% of methacryloyl group as compared with the total weight of vehicle.

With this ink employed, transcription-printing was carried out on a gravure-offset printing machine. On the intaglio plate was formed a stripe-shaped line pattern or recessed portions 30μ deep with the line width of 150μ. The transcription speed was 200 mm/sec both on the plate and on the printed material (face plate). The following results were obtained by selecting the cylindrical transcriber as follows:

| | Rubber hardness | Rubber layer thickness |
|---|---|---|
| A Urethane-rubber-coated cylindrical transcriber | 10° | 1.65mm |
| B Silicone-rubber-coated cylindrical transcriber | up to 1° | 1.65mm |

Silicone rubber composition:
Shin-etsu Silicone Co., Ltd., Japan

| | |
|---|---|
| KE 116 RTV: | 100 (parts) |
| RTV Thinner: | 100 |
| Cat. RM: | 0.5 |

The specifications of the gravure-offset printing performance of these cylindrical transcriber are given as follows:

| Transferring cylinder | Ink transferability | Stripe reproducibility after 100 continuous cycles of transcription | Accuracy in transferring location |
|---|---|---|---|
| A | Good | Good | Good |
| B | Good | Very good | Good |

When the aforesaid ink was used with a conventional gravure-offset blanket (e.g., gravure-offset blanket from Kinyo-sha Co., Ltd., Japan—JIS A rubber hardness: 60° to 70°) in printing in accordance with the same printing specifications, the film thickness was 2 to 3μ, and the ink picture was subject to blots—poor reproduction. According to this example, however, there was obtained a black stripe picture very high in light-shielding property whose reproducibility was stabilized during the continuous transcription especially on the transcriber B. Further, the accuracy in transferring location proved highly satisfactory as a whole, being free from such deformation as is characteristic of octopus head printing.

EXAMPLE 2

There could be obtained a sharp picture subject to hardly any blurs by setting the plate for transcription with the longitudinal direction of the stripe pattern in alignment with the rotating direction of the transcriber according to the printing specifications of Example 1.

EXAMPLE 3

By using the transcriber B with the following transcription speeds in the same manner as in Example 1, the results were given as follows:

| Transcription speed (mm/sec) | | Transferability | Stripe reproducibility |
|---|---|---|---|
| (On plate) | (On printed material) | | |
| 80 | 200 | Very good | Good |
| 200 | 200 | Good | Good |

Further, the resultant film thickness could attain 8μ and above with each transferring speed, while a light-shielding stripe picture with satisfactory impression was obtained with varying transferring speed.

EXAMPLE 4

A hot blast at some 150° C. was applied for 30 seconds by means of a hot-air dryer to the graphite ink layer transferred on to the transcriber B at a reduced on-plate speed as in Example 3 immediately before transferring the layer on to the printed material or face plate. Thereafter, when the transcriber was rotated with a proper printing pressure on the printed material, the ink film on the cylinder was transferred on to the printed material at nearly 100%, no portions of the ink layer remaining on the cylinder. While a complete cycle of these printing to drying processes was continuously repeated approximately 200 times, 100% transference could be reproduced on each occasion by adjusting the drying degree.

EXAMPLE 5

A green phosphor film was prepared by printing between the light-shielding stripes on a face plate with light-absorbing stripes formed thereon as prepared according to the method of Example 1, with the ink composition changed as follows:

Ink composition:

| | Volume % | (Weight %) |
|---|---|---|
| Zinc Sulfide Green Phosphor Pigment P-22 (from Dai-Nippon Paint Co., Ltd., Japan) | 35 | (70) |
| Ultraviolet-ray curing varnish (see NOTE) | 65 | (30) |

Note:
Same as that of Example 1.

The plate used had stripe-shaped recesses 30μ deep—deeper than the forming depth of the light-shielding graphite stripe picture.

In the printing-transcription, there was recognized a quality tendency similar to that with the graphite ink, while the ink film was relatively thick. Further, also according to the methods as described in Examples 3 and 4, there was noticed the same tendency; no ink remained on the transcriber and the thickness of the ink film on the face plate was 17μ or more. Transcription was made on to a face plate with a light-shielding stripe picture already formed thereon, exhibiting satisfactory ink transferability and accuracy in transferring location.

Moreover, the spaces between the light-shielding stripes could be filled up with three-color (red, green and blue) phosphor ink layers by repeating the aforesaid cycle of processes three times with the phosphor pigment replaced by blue and red phosphor pigments (P-22 from Dai-Nippon Paint Co., Ltd., Japan), with the same quantitative composition. When laying one color on top of another, the surface layer of the previously printed ink film was irradiated for 20 seconds by means of an ultraviolet radiator for setting before the subsequent printing process.

EXAMPLE 6

When an aluminium film was formed to a thickness of 2,000 Å directly on a phosphor screen prepared according to the method of Example 5 under a pressure of $4\times10^{-5}$ Torr by the vacuum-evaporation method at a filming speed of 25 Å/sec, and fired at 450° C. for an hour, the resin contained in the ink was turned into an incinerated gas without destroying the aluminium surface, thus producing a satisfactory phosphor screen.

Further, the prescribed brightness and whiteness degree could be obtained by applying electron beams to the phosphor screen which had been made into a tube by means of a suitable process.

Meanwhile, the aluminium surface (metal-back) exhibited a moderate smoothness, requiring no such intermediate film formation as is the case with the phosphor screens prepared by the photographic process.

EXAMPLE 7

The phosphor film printed in Example 5 was left for approximately 6 hours with every printing of a color; when the film surface was rendered smooth, it was exposed to ultraviolet-rays, and ink was set for a subsequent phorphor-ink printing. At this point of time, there was noticed a distinct difference in gloss as compared with those films which were exposed to ultraviolet-rays immediately after printing.

When thus obtained phosphor screen was aluminium-evaporated, fired, and exposed as a tube to a prescribed dose of electron beams, the brightness was improved by approximately 20% as compared with those screens which had not been left for 6 hours, and the whiteness degree varied a little.

EXAMPLE 8

When 3% by weight of dibutyl phthalate (as compared with the total quantity) was added to the ink of the composition of Example 5, and a resultant phosphor screen was left for an hour after printing, aluminium-evaporated, burnt, and exposed as a tube to a prescribed dose of electron beams, the brightness was improved by approximately 20% as compared with the screens with no such addition.

EXAMPLE 9

When 6% by weight of calcium carbonate (as compared with the total quantity) was added to the red phosphor ink of the composition of Example 5, the whiteness degree could be changed from the original reddish tone to a pale-bluish tone without constituting any hindrance to the subsequent processes including aluminium-evaporation, burning, and tubulation. Effective chromaticity adjustment was achieved without involving red-colored turbidity which might be caused by any mixed calcium carbonate. Further, the variation in whiteness degree was very small, which secured acquisition of the correct color as specified.

EXAMPLE 10

Printing over a prescribed area could be achieved by using as the printing material a silicone-rubber-coated cylinder (with the same rubber composition as that of Example 1), that is, 500 R cylindrical glass face plate instead of using the flat face plate with the inner surface coated with a silicone rubber layer of 20 mm thickness and 1° rubber hardness.

What we claim is:

1. A method for manufacturing a phosphor screen for a color picture tube comprising the steps of transferring an ink pattern contained on an intaglio having a surface comprising ink receiving portions with a depth of 10μ or more, said ink containing 15 to 90% by volume of phosphor powder, by rotatably moving at a first speed a transcriber having a cylindrical surface covered with a 0.2 to 3.0 mm thick layer of a soft material having a rubber hardness of 50° or less, along the surface of the intaglio in order to apply the ink pattern onto the cylindrical surface of the transcriber and transcribing said ink pattern from said transcriber onto an object to be printed for a color picture tube by rotatably moving the transcriber at a second speed along the surface of said object, said second speed being higher than said first speed.

2. The method for manufacturing a phosphor screen for a color picture tube according to claim 1, wherein said soft material is selected from the group consisting of silicone rubber and a fluorine base resin.

3. The method for manufacturing a phosphor screen for a color picture tube according to claim 1, wherein the moving speed of said transcriber on said intaglio is 100 mm/sec or lower.

4. The method for manufacturing a phosphor screen for a color picture tube according to claim 1, wherein ink transferred from said intaglio onto said transcriber is transcribed onto said object to be imprinted after half-drying the exposed surface of said ink.

5. The method for manufacturing a phosphor screen for color picture tube according to claim 1, wherein a pattern on the phosphor screen to be prepared is stripe-shaped, and the stripe direction is in line with the moving direction of said transcriber.

6. The method for manufacturing a phosphor screen for a color picture tube according to claim 1, wherein said object to be imprinted is a face plate for the color picture tube and said transcribing step comprises applying the ink pattern directly to the face plate.

7. The method for manufacturing a phosphor screen for a color picture tube according to claim 1, wherein said object to be imprinted is a phosphor screen glass to be attached to the inner surface of a face plate for the color picture tube.

8. The method for manufacturing a phosphor screen for a color picture tube according to claim 1, wherein said object to be imprinted is a heat-resisting plastic film to be attached to the inner surface of a face plate for the color picture tube.

9. The method for manufacturing a phosphor screen for a color picture tube according to claim 1, wherein said object to be imprinted is a transfer paper support for transferring the ink pattern onto a face plate for the color picture tube.

10. The method for manufacturing a phosphor screen for color picture tube according to claim 1, wherein said ink additionally contains at least one material selected from the group consisting of precipitation promotors, plasticizers, and slow-drying solvents.

11. The method for manufacturing a phosphor screen for a color picture tube according to claim 1, wherein said ink additionally contains an inorganic material to prevent transmission of electron beams without producing any effect on the luminous property of said phosphor powder.

12. The method for manufacturing a phosphor screen for a color picture tube according to claim 1, wherein a phosphor pattern is formed after preformation of a light-absorbing pattern on said face plate.

13. The method for manufacturing a phosphor screen for color picture tube according to claim 1, wherein the soft material covering the cylindrical surface of the transcriber is further coated with a material selected from the group consisting of silicone compounds and fluorine compounds.

14. The method for manufacturing a phosphor screen for a color picture tube according to claim 1, wherein said ink contains 25 to 85 volume percent of resin.

15. The method for manufacturing a phosphor screen for a color picture tube according to claim 14, wherein the resin contained in said ink is selected from the group consisting of polyester resin and acrylic resin.

16. The method for manufacturing a phosphor screen for a color picture tube according to claim 14, wherein the resin contained in said ink is selected from the group consisting of ultraviolet-ray curing polyester resins and ultraviolet-ray curing acrylic resins.

* * * * *